US006374552B1

(12) United States Patent
Price

(10) Patent No.: US 6,374,552 B1
(45) Date of Patent: Apr. 23, 2002

(54) SKIRTING WALL SYSTEM

(75) Inventor: Raymond R. Price, Rochester, MN (US)

(73) Assignee: Alliance Concrete Concepts, Inc., Rochester, MN (US)

( * ) Notice: Subject to any disclaimer, the term of this patent is extended or adjusted under 35 U.S.C. 154(b) by 0 days.

(21) Appl. No.: 09/547,206

(22) Filed: Apr. 12, 2000

(51) Int. Cl.[7] ..... E04B 2/56; B60R 27/00

(52) U.S. Cl. ..... 52/169.12; 52/98; 52/477; 52/482; 52/779; 52/DIG. 3

(58) Field of Search ..... 52/777, 779, 169.12, 52/169.2, 586.1, 475.1, 477, 482, 598, 605, 763, 513, DIG. 3, 98, 597, 601, 762, 764; 256/13.1, 19

(56) References Cited

U.S. PATENT DOCUMENTS 1,509,424 A * 9/1924 Garrard
2,158,732 A * 5/1939 Shannon ..... 52/586.1 X
2,703,004 A * 3/1955 Kenedy ..... 52/477 X
2,787,812 A * 4/1957 Long ..... 52/779
3,381,437 A * 5/1968 Kidney
3,412,515 A * 11/1968 Finon
3,427,771 A * 2/1969 Cacossa
3,608,928 A 9/1971 Hooker
3,888,055 A * 6/1975 Gallo ..... 52/98
4,214,412 A 7/1980 Barylski
4,549,378 A 10/1985 Ayers et al.
4,656,797 A 4/1987 Marquart
4,738,061 A 4/1988 Herndon
5,363,620 A * 11/1994 Liu ..... 52/482
5,501,050 A * 3/1996 Rule ..... 52/513
6,125,597 A 10/2000 Hoffman et al.

* cited by examiner

*Primary Examiner*—Robert Canfield
(74) *Attorney, Agent, or Firm*—Moore & Hansen

(57) ABSTRACT

A composite masonry block and wall system for skirting elevated structures. The block is shaped to be stacked in vertically independent columns, held in place by specially shaped, lightweight beams placed between adjacent columns, and also by synthetic U-shaped lateral supports which open downwardly and are attached to the bottom of the elevated structure.

34 Claims, 2 Drawing Sheets

14
14
14
10
4
4
12
12
5
5

28a
34
24
12
22
34
20
21
32
28b
26
30

36
38b
42
40
40
16
38a 14
48
50
45
46
44
18
47
12
34
12
16
12
34
42

12
22
24
34
16
34
12
24
22
30
21
20
14
28a
28b
21
20
14

SKIRTING WALL SYSTEM

BACKGROUND OF THE INVENTION

Mobile homes, trailer homes, and modular homes are residential structures that are not built on a foundation. As a result, in order to prevent shifting and sinking of these structures, and moreover to ensure the structure is level regardless of the ground's topography, they are placed on stilts or supports that protrude from the ground and elevate the structure thereabove. This causes a visible gap in some areas between the ground and the bottom of the structure. The present invention relates to a decorative and structural composite masonry block designed for the purpose of skirting these structures and covering any such gaps.

Mobile home skirting efforts, until now, have resulted in a variety of products which are either prohibitively expensive, or unattractive and unable to withstand sustained exposure to nature's elements. Attempts that fall into the latter category include such easily breakable products as wooden cross-hatching and plastic or foam panels that imitate a stone or brick wall. Solutions that tend to be prohibitively expensive or difficult to install include large, custom-made, cement slabs having a decorative face, and the use of standard cinder blocks and mortar to build a wall around the bottom of the structure.

There is a need for a sturdy, inexpensive alternative for skirting a mobile home which is easy to install.

SUMMARY OF THE INVENTION

The present invention provides a composite masonry block and wall system to be used to skirt elevated structures. The block is shaped to be stacked in vertically independent columns, held in place by specially shaped, lightweight, synthetic beams placed between adjacent columns, and also by synthetic U-shaped lateral supports which open downwardly and are attached to the bottom of the elevated structure.

The blocks comprise a split front face, a rear face, top and bottom surfaces, and side surfaces. The side surfaces comprise grooves for receiving supporting portions of the synthetic beams. The top and bottom surfaces are preferably shaped so that when an upper block is stacked on a lower block, the lower surface of the upper block sits on the upper surface of the lower block and the two blocks are relatively coplanar and vertical. This configuration is most easily accomplished using blocks having flat top surfaces and flat bottom surfaces that are relatively perpendicular to the front and rear faces. It would also be possible to accomplish this vertical block-to-block relationship using top and bottom surfaces comprised of complementary angles and/or curves.

The synthetic beams are preferably a weather resistant metal or plastic, nylon or other synthetic, durable, inexpensive material, such as poly-vinyl chloride (PVC). The purpose of the beams is to keep the independent vertical columns from buckling when subjected to a force normal to the plane of the wall. The rigidity of the blocks provides enough support to prevent failure in other directions. This purpose may be accomplished using relatively thin beams having lateral extensions for being received by the grooves in the sides of the blocks.

Preferably, these beams provide little to no support in a vertical direction. They merely maintain the blocks in independent vertical columns. The columns are considered independent because, unlike conventional brick or stone walls, one horizontal course of blocks is aligned with the adjacent upper and lower courses so that the blocks in each course are in line with the blocks above and below them, as opposed to being laterally offset. This results in the formation of vertical columns of blocks that can move up and down, due to forces exerted by the ever-shifting earth, without upsetting, or otherwise exerting forces on, adjacent columns of blocks.

The resulting wall of this system is surprisingly strong. It may even be used to provide support to the elevated structure. Once installed the elevated structure may be lowered onto the blocks. Alternatively, the blocks may merely serve as a skirt which improves the aesthetics of the structure and keeps unwanted birds and animals from nesting or otherwise residing under the structure. In this embodiment, it is not necessary that the blocks make actual contact with the structure.

The use of the lateral support beams also obviates the need for mortar between the blocks. This mortarless system is advantageous over traditional brick and mortar walls for obvious reasons. First, fewer materials are required to build a wall. Second, a wall can be easily constructed by one person at that person's leisure. There are no time constraints imposed by drying mortar. Third, the wall can be constructed regardless of weather conditions. Also, the loose block system can be constructed on any surface, including sand, gravel, dirt or concrete. It is not necessary to pour a foundation.

The lateral support beams also allow the use of relatively thin blocks. These thin, wafer-like blocks are relatively light-weight, resulting in ease of handling and shipping, and a reduction in material costs. The blocks are preferably between 1 and 4 inches thick, more preferably on the order of 2½ inches thick. As they are generally between 6 and 12 inches in height, it would be difficult to use such a tall thin block to create a brick wall using mortar. The tall, thin blocks would have to be held in place somehow to allow the mortar to dry. However, tall thin blocks provide certain advantageous and the present invention provides a way of incorporating the advantageous of such a block. These advantageous include an increased front face surface area, resulting in a more attractive wall. The design also provides increased lateral support, ideal for use with such a beam system.

The loose block system also allows the wall to be disassembled and reassembled. This not only gives flexibility during initial construction, but allows later renovations to be made easily and inexpensively. For instance, often it is desirable to vent skirting walls to prevent the buildup of moisture or condensation between the ground and the elevated structure. These vents can be easily installed into an existing wall, especially if they are of similar dimensions and configurations as the blocks. The blocks of a given column are simply removed and reinstalled, replacing one of the blocks with the vent. Other auxiliary items, such as an access door or lights, could be installed in a similar manner.

Finally, the wall design of the present invention allows a wall corner to be constructed without supporting beams or mortar. Two walls are simply aligned to form a butt joint and fasteners such as appropriate plastic pegs or screws and plastic inserts are used to fasten one wall to the other. Alternatively, construction mastic, a type of adhesive, may be applied instead of or in combination with the screws. Again, ease of installation is greatly improved by the loose block, mortarless system of the present invention.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

DETAILED DESCRIPTION

Figures 1, 2, 3, 4, 5:
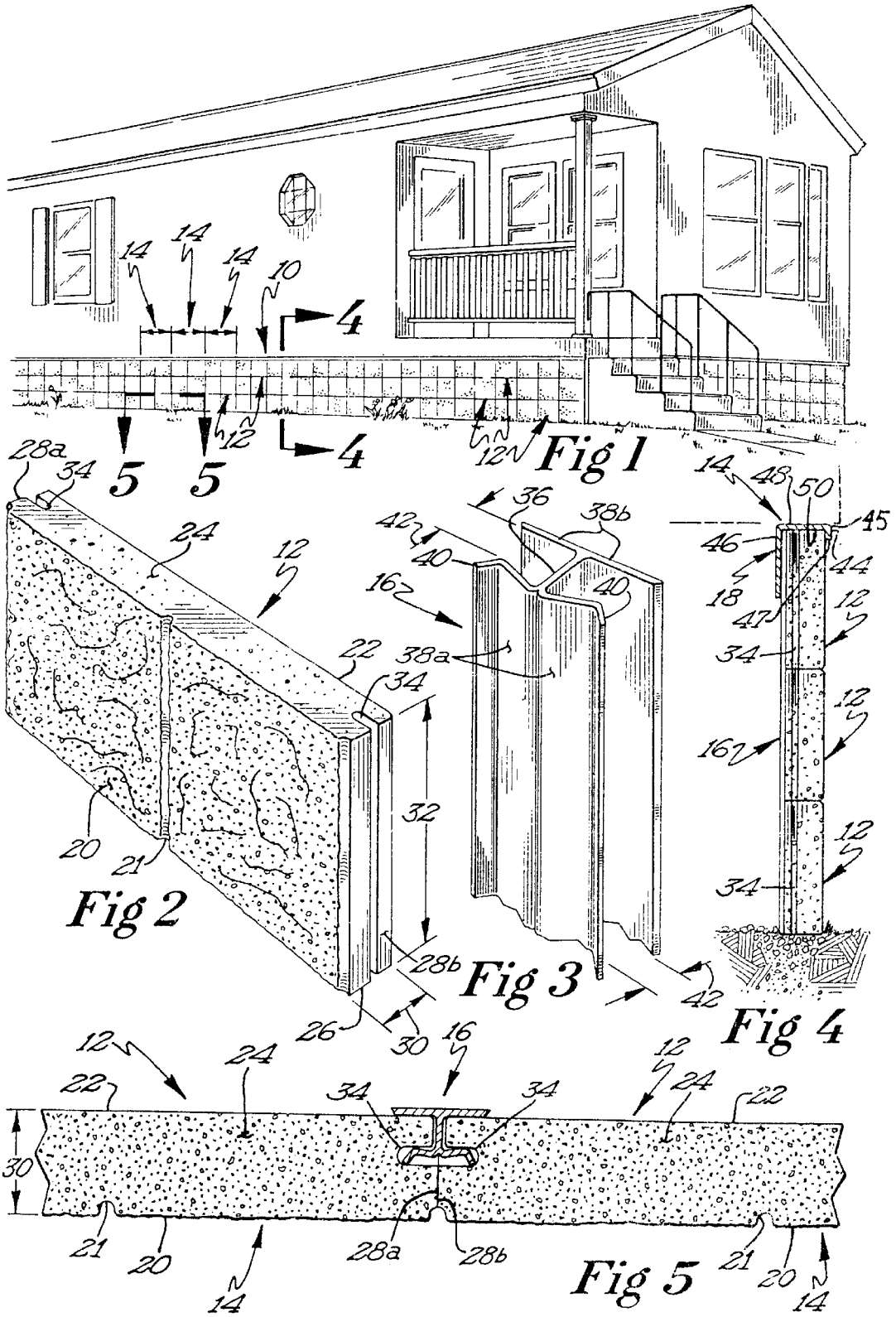
FIG. 1 is a perspective view of an elevated structure skirted with the wall system of the present invention.
FIG. 2 is a perspective view of a block of the present invention.
FIG. 3 is a perspective view of a support beam of the present invention.
FIG. 4 is a side elevational view of a column of the present invention taken generally along lines 4—4 of FIG. 1.
FIG. 5 is a plan view, taken generally along lines 5—5 of FIG. 1, of two adjacent blocks of the present invention abutted and held by a support beam.

Referring now to the drawings and first to FIGS. 1–4, there is shown a skirting wall 10 comprised of a plurality of blocks 12 forming columns 14 partially spaced apart and held in place by vertically oriented, lateral support beams 16. Downward opening brackets 18 attached to the bottom of the structure being skirted, are placed over the top block 12 of selected columns 14 to help prevent wall 10 from tipping rearwardly or forwardly. As used herein, the term "forward" means away from the center of the elevated structure and the term "rearward" means toward the center of the elevated structure.

Attention is now directed to the individual components of wall system 10. FIG. 2 depicts a preferred embodiment of block 12. It can be seen that block 12 generally comprises a front face 20, a rear face 22, a top surface 24, a bottom surface 26 and side surfaces 28*a* and 28*b*. Block 12 is preferably made of a dry composite masonry material which hardens quickly when compressed in a mold. It is envisioned that other materials could be used, such as concrete, fiberglass, ceramics, hard plastics, or dense foam. The present invention would also be achieved if blocks 12 were formed of wood, preferably treated wood. Though the general shape of the blocks is more important to achieve the present invention than the material used, it has been found that the aforementioned preferred dry composite masonry material provides the most desirable combination of strength, appearance, economy, and ease of manufacturing.

Front face 20 is forwardly spaced from rear face 22 by a predetermined distance herein defining the depth 30 of block 12. As shown in FIG. 2, it is envisioned that front face 20 is formed using a splitting process, thereby forming an attractive, roughened face. This, however, is not necessary to carry out the spirit of the invention. Front face 20 could alternatively be molded, pressed, carved, etched, painted, or otherwise formed in any manner. Preferably, depth 30 is relatively constant throughout the extents of block 12, excepting the variations caused by the splitting process and also excepting splitting recesses or other interruptions in the split look of front face 20. Splitting recesses 21 are preferably formed in front face 20 to provide an area for splitting block 10 along a straight line.

Top surface 24 is separated from bottom surface 26 by a distance defining the height 32 of block 12. When blocks 12 are arranged vertically to form a column 14, bottom surface 26 of any block 12 other than the bottom block of a column, rests on the top surface 24 of the block below. It is therefore preferred that top surface 24 and bottom surface 26 are so shaped to facilitate a stacking relationship between two blocks 12 that results in an upper block 12 resting vertically on a vertically oriented lower block 12. This relationship is most easily achieved by making top surface 24 and bottom surface 26 flat and relatively perpendicular to rear face 22 and/or front face 26, as shown in the Figures. Alternatively, it is envisioned that top and bottom surfaces 24 and 26 be comprised of complementary angles which are not perpendicular to rear face 22 and/or front face 26, but result in the vertical relationship between upper and lower blocks 12, described above. It is also envisioned that this relationship be achieved through the use of concave and convex surfaces or using tongue and groove configurations.

Side surfaces 28*a* and 28*b*, as shown in FIG. 2, are preferably somewhat perpendicular to rear face 22 and/or front face 20 and preferably comprise a groove 34 for receiving a portion of beam 16, shown in FIG. 3. Alternatively, it is envisioned that one side surface 28*a* or 28*b* have a groove and the other side surface have a tongue configured to mate with the groove, thereby obviating the need for beams 16. However, in order to maintain the vertically independent characteristics of columns 14, the use of beams 16 is preferred.

Beams 16, shown in FIG. 3, preferably comprise a spine or web 36 and at least one rib 38. Preferably there are two pairs of ribs 38*a* and 38*b*. This configuration of two pairs of ribs 38*a* and 38*b* attached to each other by web 36 forms somewhat of an I beam configuration. It is preferred that one set of ribs 38*a* are resiliently deformable and even more preferred that they comprise flanges 40 to assist in guiding them into grooves 34. A biased, resiliently deformable rib 38*a* places an even force on groove 34 and prevents movement and misalignment between blocks 12 of a given column 14.

The distance between rib 38*a* and 38*b* is herein defined as the span 42 of the rib. The span 42 should either be as great as the distance between the groove 34 and the rear face 22, or, in the case of the resiliently deformable rib 38, should be able to achieve this distance through deformation when installed into the groove 34 of a block 12.

Beams 16 may or may not be attached at their upper ends to the structure being skirted, at or near its bottom. Attaching beams 16 thusly provides support to the independent columns 14, preventing them from leaning or falling forwardly or rearwardly. Beams 16 also act to align the blocks 12 of a given column 14, ensuring that the blocks maintain a somewhat coplanar relationship.

Figure 6:
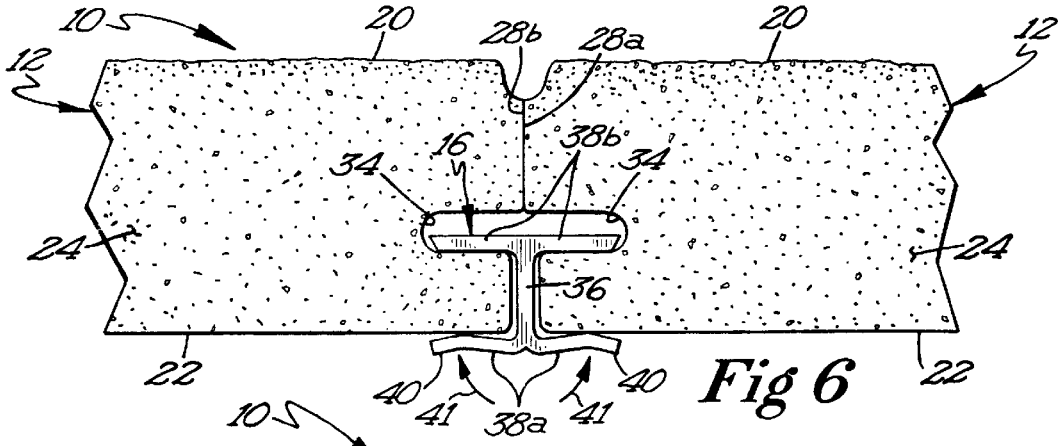
FIG. 6 is a plan view of two blocks abutted with a support beam installed using an alternative configuration.
Figure 7:
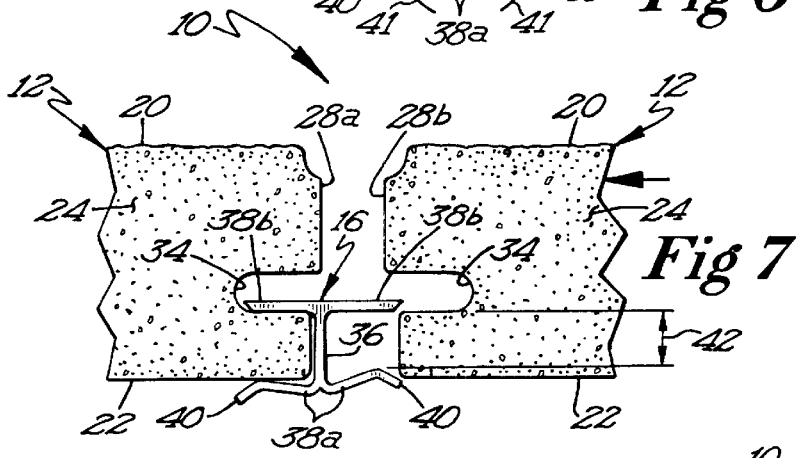
FIG. 7 is a plan view of two blocks being pressed together and resiliently deforming a support beam.

FIGS. 6–9 show a variety of envisioned beam constructions and arrangements. FIG. 6 shows a preferred arrangement of the preferred beam construction shown in FIGS. 3 and 5. It can be seen that preferably, beam 16 is placed in the opposing grooves 34 of adjacent blocks 12 so that resiliently deformable ribs 38*a* having flanges 40 are rearward of ribs 38*b*. Doing so utilizes the forces exerted by the bias of ribs 38*a* to press the forward edges of opposing sides 28*a* and 28*b* together so that no gap is seen from the front of the wall. These forces are represented by arrows 41. FIG. 7 shows how flanges 40 act to guide block 12 into beam 16 and also to assist in increasing span 42.

Figure 8:
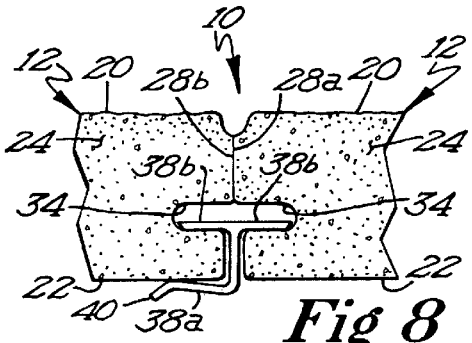
FIG. 8 is a plan view of two blocks abutted with an alternative embodiment of a support beam.
Figure 9:
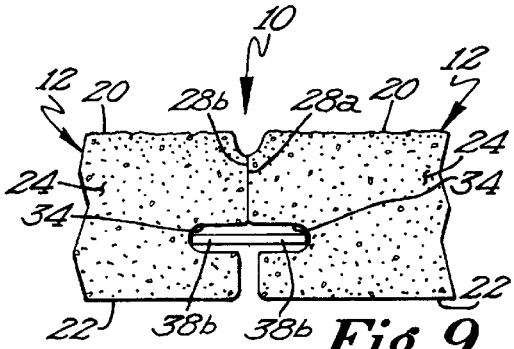
FIG. 9 is a plan view of two blocks abutted with another alternative embodiment of a support beam; and, FIG. 10 is a plan view of a corner of the skirting wall system of the present invention.

FIG. 8 shows an alternative embodiment of beam 16 having two ribs 38*b*but only one resiliently deformable rib 38*a*. FIG. 9 shows yet another embodiment of a beam 16 comprising one pair of opposed ribs 38*b* such that web 16, joining ribs 38*b*, does not need to extend past the surface of ribs 38*b*, thereby leaving web 16 invisible.

It is envisioned that brackets 18 be used in conjunction with beams 16 to provide stability to wall 10. Referring now to FIG. 4, it can be seen that brackets 18 comprise a front wall 44 having a top edge 45 and a bottom edge 47, a rear wall 46 rearwardly spaced apart from front wall 44, and a top wall 48 joining top edge 45 of front wall 44 and rear wall 46. Front wall 44 and rear wall 46 define a downward opening 50 into which the top surface 24 of the top block 12 of a column 14 may be inserted. In operation, bracket 18 is attached to the underside of a structure to be skirted and positioned so that the top block 12 of a column 14 is inserted into opening 50 and so that the bracket is located near the middle of the block 12. It may be desired to make rear wall 46 of a greater vertical dimension that front wall 44 to provide additional support. It may also be desired to provide a bracket 18 with a rear wall 46 which extends in a lateral direction further than front wall 44. Furthermore, it is envisioned that brackets 50 could be a variety of lengths. For instance brackets 50 could be as short as one inch or as long as the entire wall.

Brackets 18 prevent rearward or forward movement of column 14 and also work in conjunction with beams 16 to prevent those columns 14 without brackets 18 from tipping over rearwardly or forwardly. As it is envisioned that beams 16 may or may not be attached to the structure, brackets 18 may be solely responsible for preventing wall 10 from tipping over. Brackets 18 can be of any suitable material, preferably synthetic, more preferably poly-vinyl chloride (PVC) or other durable plastic. It may be advantageous to make brackets 18 and beams 16 out of similar material.

Figure 10:
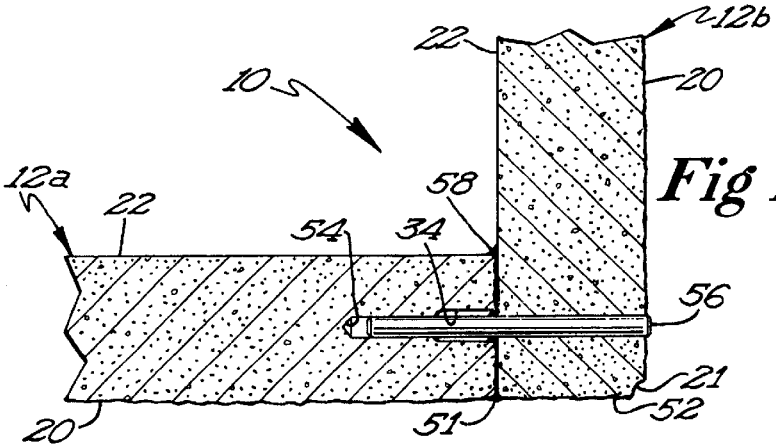

FIG. 10 shows a preferred corner configuration using the blocks 12 of the present invention. Block 12 lends itself cornering without the need for mortar, corner braces or other supports. Two blocks 12*a* and 12*b* are simply aligned to form a corner butt joint 51. Preferably block 12*b* is broken along its splitting recess 21 to form a new split face 52 which roughly matches split front face 20 of block 12*a*. Holes 54 are drilled through blocks 12*a* and 12*b* so that fastener 56 may be inserted. Fastener 56 may be any suitable fastener, preferably a screw or peg. Preferably such as appropriate plastic pegs or screws and plastic inserts are used to fasten one wall to the other. Alternatively, glue, preferably construction mastic 58, may be applied instead of or, more preferably, in combination with fasteners 56.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A wall system for skirting elevated structures comprising:

a plurality of vertically oriented, elongate beams, each of said beams comprising:

a vertical web; and, a first pair of ribs integrally formed with and extending from said web to provide a unitary beam structure;

a plurality of blocks arranged in columns, each of said blocks comprising:

a front face;

a rear face separated from said front face by a distance defining the depth of said block;

a top surface;

a bottom surface separated from said top surface by a distance defining the height of said block, said bottom surface shaped to rest on the top surface of a lower block in the same column as said block such that a relatively coplanar, vertical relationship results between said block and the lower block;

opposing side surfaces each having a groove shaped to accept a portion of a rib with said web extending between the block side surfaces for a distance not substantially greater than the depth of the blocks;

wherein said vertical columns are arranged adjacently with each other to form said wall such that adjacent said side surfaces oppose each other;

wherein said beams are constructed and arranged between said columns such that portions of said ribs reside in said grooves, thereby providing support to said columns in directions not coplanar with said wall.

2. The system of claim 1, each said beam further comprising a second pair of ribs extending from said web, wherein said first pair of ribs is forwardly separated from said second pair of ribs by a distance defined as the span of said ribs.

3. The system of claim 2 wherein said span of said ribs is at least as great as a distance measured between said grooves and said rear face of each of said plurality of blocks.

4. The system of claim 2 wherein said span of said ribs is less than a distance measured between said grooves and said rear face of each of said plurality of blocks and wherein at least one of said pairs of ribs is resiliently deformable such that when said blocks are mated with each said beam, at least one rib of said pair of resiliently deformable ribs deforms, thereby increasing said span to at least as great as said distance between said grooves and said rear face of each of said plurality of blocks.

5. The system of claim 1, said ribs further comprising angled flanges for guiding said ribs into said grooves.

6. The system of claim 1, wherein at least one said beam further comprises an odd number of ribs extending from said web.

7. The system of claim 1, wherein each said beam further comprises a third rib which is offset from said first pair of ribs and extending laterally from said web.

8. The system of claim 1, wherein each said block front face further comprises a split face.

9. The system of claim 8, wherein each said block front face further comprises at least one splitting recess for allowing said block to be split roughly along a line generally perpendicular to said front face.

10. The system of claim 1, wherein each said block top surface and said block bottom surface are flat.

11. The system of claim 1 wherein each said block top surface and said block bottom surface comprise at least one set of complementary angles.

12. The system of claim 11 wherein each said block top surface and said block bottom surface are substantially perpendicular to said block rear face.

13. A wall system for skirting elevated structures comprising:

a plurality of vertically oriented, elongate beams, each of said beams comprising:
a vertical web; and,
at least one rib extending laterally from said web;

a plurality of blocks arranged in columns, each of said blocks comprising:
a front face;
a rear face separated from said front face by a distance defining the depth of said block;
a top surface;
a bottom surface separated from said top surface by a distance defining the height of said block, said bottom surface shaped to rest on the top surface of a lower block in the same column as said block such that a relatively coplanar, vertical relationship results between said block and the lower block;
opposing side surfaces having grooves shaped to accept portions of said at least one rib;

a downwardly opening bracket for attachment to the elevated structure, said bracket comprising:
a front wall having a top edge and a bottom edge downwardly displaced from said top edge;
a top wall extending rearwardly from said front wall top edge;
a rear wall extending downwardly from said top wall and spaced rearwardly from said front wall:

wherein said vertical columns are arranged adjacently with each other to form said wall such that adjacent said side surfaces oppose each other;

wherein said support beams are constructed and arranged between said columns such that portions of said ribs reside in said grooves, thereby providing support to said columns in directions not coplanar with said wall; and, wherein said front, top and rear walls of said bracket are constructed and arranged to form an opening into which a portion of said top surface of an uppermost block in a said column may be inserted such that said bracket front wall prevents said column from tilting forwardly and said bracket rear wall prevents said column from tilting rearwardly.

14. The system of claim 13 wherein said bracket rear wall extends downwardly a greater distance than said bracket front wall.

15. The system of claim 13 wherein said bracket rear wall extends laterally a greater distance than said bracket front wall.

16. A system of walls for skirting angled portions of elevated structures comprising:

a plurality of vertically oriented, elongate beams, each of said beams comprising:
a vertical web; and,
at least one rib extending laterally from said web;

a plurality of blocks arranged in vertical columns, each of said blocks comprising:
a front face;
a rear face separated from said front face by a distance defining the depth of said block;
a top surface;
a bottom surface separated from said top surface by a distance defining the height of said block, said bottom surface shaped to rest on the top surface of a lower block in the same column as said block such that a relatively coplanar, vertical relationship results between said block and the lower block;
opposing side surfaces having grooves shaped to accept portions of said at least one rib;

at least one fastener;

wherein some of said vertical columns are arranged adjacently with each other to form a first wall such that adjacent said side surfaces oppose each other;

wherein said support beams are constructed and arranged between said columns such that portions of said ribs reside in said grooves, thereby providing support to said columns in said first wall in directions not coplanar with said first wall;

wherein some of said vertical columns are arranged adjacently with each other to form a second wall such that adjacent side surfaces oppose each other;

wherein said support beams are constructed and arranged between said columns such that portions of said ribs reside in said grooves, thereby providing support to said columns in said second wall in directions not coplanar with said second wall;

wherein said first and second wall are constructed and arranged to abut with each other to form an angle on the order of ninety-degrees; and, wherein said fastener retains the first and second walls in place relative to each other.

17. The system of claim 16 wherein one of said columns comprises a plurality of said blocks which have been split to form a broken side surface.

18. The system of claim 16 wherein said fastener comprises a peg.

19. The system of claim 16 wherein said fastener comprises an adhesive.

20. The system of 19 wherein said adhesive further comprises construction mastic.

21. The system of claim 16 wherein said fastener comprises a peg and an adhesive in combination.

22. A mortarless base wall for at least partially supporting a structure comprising:

a plurality of vertically oriented, elongate synthetic beams, each of said beams comprising:
a vertical web;
at least two ribs extending laterally from said web;

a plurality of blocks arranged in columns, each of said blocks comprising:
a front face;
a rear face separated from said front face by a distance defining the depth of said block;
a top surface;
a bottom surface separated from said top surface by a distance defining the height of said block, said bottom surface shaped to rest on the top surface of a lower block in the same column as said block such that a relatively coplanar, vertical relationship results between said block and the lower block;
opposing side surfaces having grooves shaped to accept portions of said ribs;

wherein said vertical columns are arranged adjacently with each other and aligned by said beams;

wherein the structure rests on said top surfaces of the top block of each of said columns, causing the wall to support a predetermined percentage of the weight of the structure.

23. A block for use in constructing a multiple column, skirting wall for an elevated structure comprising:

a split-face front surface;

a rear face separated from said front face by a distance defining the depth of said block;

a top surface;

a bottom surface separated from said top surface by a distance defining the height of said block, said bottom surface shaped to rest on the top surface of a lower block in the same column as said block such that a relatively coplanar, vertical relationship results between said block and the lower block;

opposing side surfaces separated form each other by a distance defining the width of said block, with each said opposing side surface having a groove shaped to accept a portion of a vertically oriented, lateral support beam wherein, a plurality of blocks may be stacked one on top of each other in a columnar fashion and retained in position at their grooved opposing sides by at least one vertically oriented, lateral support beam.

24. The block of claim 23 wherein said block further comprises a composite masonry material.

25. The block of claim 23, wherein the width is greater than the height.

26. The block of claim 23, wherein the depth is about 1–4 inches.

27. The block of claim 23, wherein the front surface further comprises at least one elongate recess extending thereacross.

28. A column for use in constructing a mortarless skirting wall for an elevated structure comprising:

a plurality of vertically stacked blocks, each of said blocks comprising:

a front face;

a rear face;

a top surface;

a bottom surface;

first and second opposed side surfaces connecting said top surface with said bottom surface, said side surfaces defining a groove;

at least one elongate support beam for retaining said blocks in a vertically stacked relation, the support beam comprising:

a vertical web;

a first pair of ribs extending from said web and a second pair of ribs extending from said web, wherein said first pair of ribs is separated from said second pair of ribs by a distance defined as the span of said ribs, and with at least one of said ribs shaped to fit within said grooves of said vertically stacked blocks for providing lateral support thereto.

29. The column of claim 28 wherein said block front faces are substantially parallel to said block rear faces.

30. The column of claim 28 wherein each said block further comprises:

a separation between said front face and said rear face defining the depth of the block;

a separation between said top surface and said bottom surface defining the height of the block; and a ratio of height to depth which is greater than 2.5 to 1.

31. The column of claim 28, wherein said span of said ribs is at least as great as a distance measured between said grooves and the rear face of each block of said plurality of blocks.

32. The column of claim 28, wherein said span of said ribs is less than a distance measured between said grooves and the rear face of each block of said plurality of blocks and wherein at least one of said pairs of ribs is resiliently deformable such that when said plurality of blocks are mated with a plurality of beams, at least one rib of said pair of resiliently deformable ribs deforms, thereby increasing said span to at least as great as said distance between said groove and said rear face.

33. The column of claim 28 wherein at least one of said ribs further comprises an angled flange for guiding said rib into said groove.

34. A column and bracket for use in constructing a mortarless skirting wall for an elevated structure, the column comprising:

a plurality of vertically stacked blocks, each of said blocks comprising:

a front face;

a rear face;

a top surface;

a bottom surface;

first and second opposed side surfaces connecting said top surface with said bottom surface, said side surfaces defining a groove;

at least one elongate support beam for retaining said blocks in a vertically stacked relation, the support beam comprising:

a vertical web;

at least one pair of ribs extending from said web with at least one of said ribs shaped to fit within said grooves of said vertically stacked blocks for providing lateral support thereto; and, a bracket attachable to an elevated structure, the bracket comprising:

a front wall;

a rear wall;

a top wall operatively connecting said front wall to said rear wall in a spaced relation;

with said front, top and rear walls constructed and arranged to form an opening into which a portion of said top surface of an uppermost block in said column may positioned such that said bracket front wall prevents said column from tilting forwardly and said bracket rear wall prevents said column from tilting rearwardly.

* * * * *